US005322571A

United States Patent [19]

Plummer et al.

[11] Patent Number: 5,322,571

[45] Date of Patent: Jun. 21, 1994

[54] METHOD AND APPARATUS FOR CLEANING HOSES

[75] Inventors: Raymond G. Plummer; Mike Kosmyna; Raymond J. Foley, all of Toledo, Ohio; J. Thomas Schaffer, Temperance, Mich.

[73] Assignee: Plummer Design & Technologies, Inc., Toledo, Ohio

[21] Appl. No.: 849,457

[22] Filed: Mar. 11, 1992

[51] Int. Cl.[5] ..... B08B 3/02; B08B 5/00; B08B 9/00; B08B 9/093

[52] U.S. Cl. ..... 134/22.12; 134/18; 134/102.1; 134/102.2; 134/169

[58] Field of Search ..... 134/22.12, 18, 102.1, 134/102.2, 169

[56] References Cited

U.S. PATENT DOCUMENTS

| | | | |
|---|---|---|---|
| 2,262,102 | 11/1941 | Hunter | 299/84 |
| 3,572,366 | 3/1971 | Wiggins | 137/240 |
| 3,981,320 | 9/1976 | Wiggins | 137/240 |
| 4,419,141 | 12/1983 | Kunkel | 134/22.12 |
| 4,497,341 | 2/1985 | Wright | 137/563 |
| 4,627,465 | 12/1986 | Kolibas et al. | 137/563 |
| 4,657,047 | 4/1987 | Kolibas | 137/881 |
| 4,874,002 | 10/1989 | Sundholm | 134/111 |
| 4,881,563 | 11/1989 | Christian | 134/166 |
| 4,902,352 | 2/1990 | Christian | 134/22.12 |
| 5,007,444 | 4/1991 | Sundholm | 134/102 |

*Primary Examiner*—Theodore Morris
*Assistant Examiner*—Zeinab El-Arini
*Attorney, Agent, or Firm*—Hugh Adam Kirk

[57] ABSTRACT

An improved method and apparatus for cleaning liquid-carrying hoses, and the like. A suitable cleaning solvent is passed under pressure through the hose. The pressure of the solvent delivered to the hose is measured and used to control the pressure of compressed air mixed with the solvent to maintain a turbulent flow of a predetermined mix ratio for various solvent pressures. The turbulent solvent/compressed air mixture increases scrubbing of the hose to reduce the cleaning time and the quantity of solvent required to clean the hose.

10 Claims, 1 Drawing Sheet

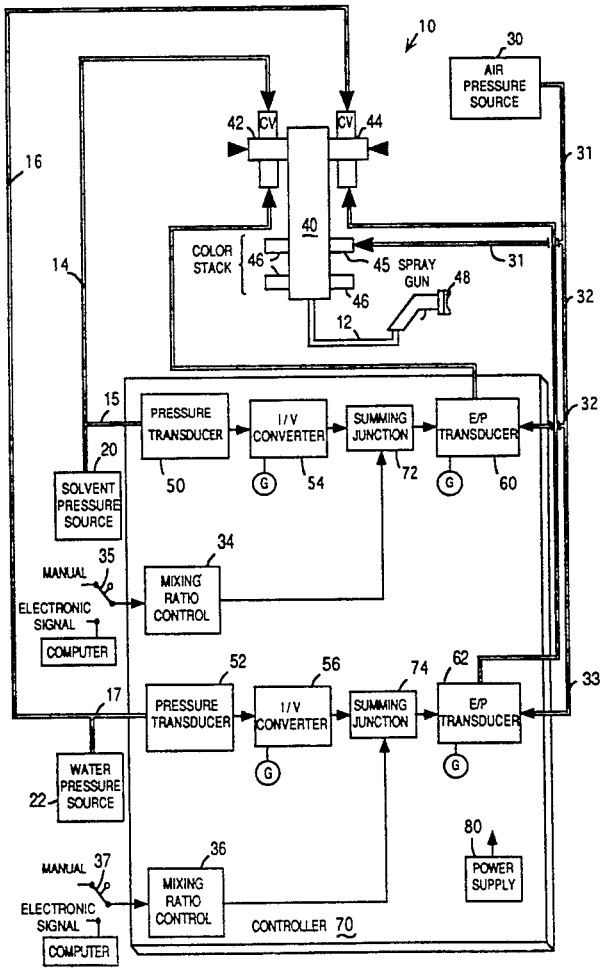

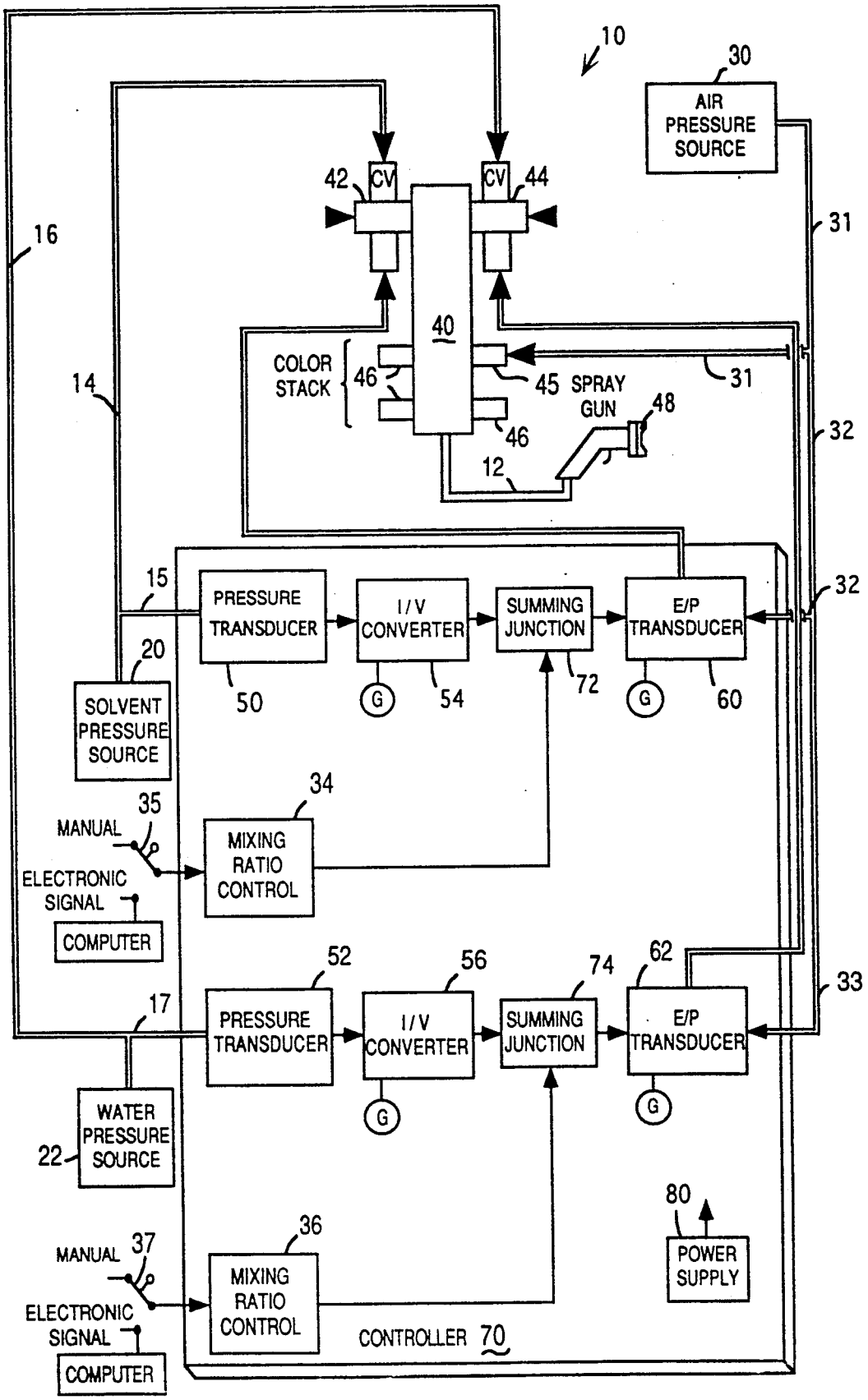
10
30
AIR PRESSURE SOURCE
42
CV
CV
44
16
31
40
COLOR STACK
46
45
SPRAY GUN
48
14
31
46
32
12
15
PRESSURE TRANSDUCER
I/V CONVERTER
SUMMING JUNCTION
E/P TRANSDUCER
32
20
50
G
54
72
G
60
SOLVENT PRESSURE SOURCE
34
35
MANUAL
MIXING RATIO CONTROL
ELECTRONIC SIGNAL
COMPUTER
52
56
74
62
33
17
PRESSURE TRANSDUCER
I/V CONVERTER
SUMMING JUNCTION
E/P TRANSDUCER
G
G
WATER PRESSURE SOURCE
22
80
POWER SUPPLY
36
MANUAL
37
MIXING RATIO CONTROL
ELECTRONIC SIGNAL
CONTROLLER 70
COMPUTER

METHOD AND APPARATUS FOR CLEANING HOSES

TECHNICAL FIELD

The invention relates to a cleaning method and apparatus and more particularly to an improved method and apparatus for cleaning fluid carrying-hoses and the like.

BACKGROUND ART

In many businesses and industries, hoses, fluid lines, duct pipes, tubes, conduits, manifolds and the like (hereinafter generically referred to as hoses) are used to carry liquids. After a specific use, it may be necessary to clean the hose. For example, hoses are used to carry paint to a spray gun. When painting is finished or when a new color paint is to be applied, it is necessary to clean all of the old paint from the hose. If residual paint is left in the hose, it may harden and eventually clog the hose. Or, if a different color paint is applied, any remaining old color paint may initially contaminate the new color paint. In another application, hoses used for carrying milk, for example, at a farm or at a milk processing plant, also must be frequently cleaned. If residual milk is left in the hose, it may spoil and contaminate milk subsequently carried through the hose.

Various techniques have been used for cleaning hoses. Often, as much liquid as possible initially may be purged from the hose with compressed air. In a painting system, the purged paint may be reclaimed for future use. A suitable solvent or cleaning solution is passed through the hose and finally the hose may be purged of solvent with a flow of compressed air. For milk, a soapy water solution may be passed through the hose, followed by clean water and air. For solvent-based paints, a paint solvent must be used, followed by air to dry the hose. It is known in the art that the cleaning efficiency may be improved by alternately pulsing solvent and compressed air through a hose to increase the scrubbing action. However, considerable quantities of solvent and an undesirable long time may be required to clean a paint hose.

In one improved system, solvent and compressed air have been mixed to produce a turbulent flow for cleaning a hose. The solvent and the compressed air are supplied through separate needle valves. Typically, the mixture is passed through a transparent hose and the valves are adjusted to visibly produce a desired turbulent mixture. However, solvent pressure may vary considerably in a commercial system. If, for example, several paint lines happen to be cleaned at the same time from a single solvent source, there may be significant solvent pressure variations. This will result in an improper solvent to air ratio and less than maximum turbulence in the solvent. If the hose is cleaned for a fixed time interval in an automated system, a solvent pressure change which reduces turbulence in the solvent may result in inadequate cleaning of the paint line.

It is desirable to reduce the quantity of solvent and the time required to clean a hose. Solvent is expensive to purchase and used solvent is expensive to dispose of since it is considered a hazardous waste. Further, in certain manufacturing businesses, such as in automobile body manufacturing, it is necessary to change paint color from workpiece to workpiece. Any reduction in the color changeover time may result in increased production and decreased manufacturing costs. The color change time generally is limited by the time required to clean the paint hoses.

DISCLOSURE OF INVENTION

According to the invention, an improved method and apparatus are provided for cleaning fluid-carrying hoses, such as paint hoses, milk hoses, and the like. The method involves passing a suitable pressurized solvent through the hose. Compressed air is added to the solvent to increase turbulence and to increase the scrubbing action. The pressure of the solvent delivered to the hose is measured with a pressure sensor and is used to control the pressure of the compressed air mixed with the solvent. By adjusting the air pressure, a desired solvent/air mix ratio may be achieved to maximize turbulence and hence to optimize cleaning. It has been found that by mixing the proper quantity of air with the solvent, the cleaning efficiency is greatly increased over a system which alternately pulses air and solvent through the hose. Consequently, both the quantity of solvent required to clean a hose may be significantly reduced and the hose cleaning time may be significantly reduced. This in turn translates into reduced manufacturing costs and increased production. The increased solvent turbulence is particularly more effective than prior art techniques for cleaning hardened or partially hardened deposits from fluid-carrying hoses.

Accordingly, it is an object of the invention to provide an improved method and apparatus for cleaning fluid hoses.

Other objects and advantages of the invention will be apparent from the following detailed description and the accompanying drawing.

BRIEF DESCRIPTION OF THE DRAWING

The single FIGURE is a schematic diagram of apparatus according to the invention for cleaning fluid from hoses and the like.

BEST MODE FOR CARRYING OUT THE INVENTION

Referring to the single drawing figure, apparatus 10 is illustrated schematically for cleaning a fluid hose 12 according to the invention. As previously indicated, the term "hose" or "duct" is used herein to refer to any fluid-carrying device including, but not limited to, a hose, a fluid line, a pipe, a tube, a conduit, a manifold, and the like. The apparatus 10 is connected through ducts or hoses 14, 15 and 16, 17 to two separate similar sources 20 and 22 of pressurized solvents, for example two different organic solvents or an organic solvent and water. A conventional source 30 of compressed air is connected to the apparatus 10 via ducts 31, 32 and 33. The solvent sources 20 and 22 may be pressurized tanks containing solvent, or a solvent tank and pump, or, if the solvent is water, a commercial water main. The compressed air source 30 may be an air compressor.

The particular solvent used with the apparatus 10 will depend on the material being cleaned from the hose 12. If the hose 12 is used to carry solvent-based paint, the solvent will be one selected for that particular paint. If the hose 12 is used to carry, for example, a water-borne paint or milk, the solvent may be water.

The solvent hoses 14 and 16 are connected either directly or through a manifold or color stack of valves 40 or by another suitable fitting to the hose 12 to be cleaned. Solvent pressure sensors 50 and 52 are located either in the solvent ducts 14 and 16 or connected thereto by ducts 15 and 17, respectively, or at the manifold 40 to measure the pressure of the solvent delivered to the hose 12. The compressed air hoses 31, 32 and 33 are connected to two voltage-to-pressure transducers 60 and 62 and thence to the two valves 42 and 44, respectively, on the manifold 40 atop of the color stack. These particular valves 42 and 44 are also mixing valves for the solvents and air, and may contain check valves.

An electric control circuit 70 contains the solvent pressure sensors 50 and 52, which sensors or transducers 50 and 52 are connected to current-to-voltage converters 54 and 56, respectively, which establish either a voltage functionally related to the solvent pressures via ducts 15 and 17 or a current having a magnitude related to the sensed solvent pressures.

Also in the electric control circuit 70 are the voltage-to-pressure control transducers 60 and 62 for each solvent which control the compressed air in ducts 32 and 33 to the mixing valves 42 and 44, respectively. The compressed air control transducers 60 and 62 are controlled in turn both by a) the sensed pressures in the solvent pressure transducers 50 and 52 and by b) the mixing ratio control circuits 34 and 36, respectively. The control voltages from these transducers 50 and 52 and control circuits 34 and 36 are joined in summing junctions 72 and 74 to control the air pressure transducers 60 and 62. The mixing or proportioning circuits 34 and 36 control the ratio of solvent to compressed air to produce an equal, leaner, or richer solvent-to-air mixture in the manifold 40. The ratio may be a predetermined constant or variable relationship to the actual solvent pressure applied to the manifold 40. The control of mixing circuits 34 and 36 may be either manually or electronically from a host controller or computer (not shown), selected by the manual switches 35 and 37, respectively.

The host process controller or computer (not shown) also controls air duct drying valve 45 and the color changer valves 46 in the color stack manifold 40. Thus, the electronic control circuit 10 may be operated as a process controller which controls both the delivery of liquid through the hose 12 and the timing and delivery of solvent and compressed air to the hose 12.

Inside the electric control circuit 70 there is provided an electric power supply 80 for all the electric circuits therein. Furthermore, the converters 54 and 56 and the transducers 60 and 62 may be provided with voltage or current gauges G for indicating the pressure of the solvent and air at their inputs and outlets, respectively, to and from the control circuit 70.

For example, for cleaning many materials from the hose 12, it may be desirable to have the compressed air at the same pressure as the pressurized solvent to obtain a 50:50 ratio of solvent and air. This may produce maximum turbulence in the hose 12 for maximizing the cleaning efficiency. For some solvents, a slightly different solvent-to-air ratio may be required for maximum solvent turbulence or it may be desirable to have more air than solvent to reduce the amount of solvent used in cleaning the hose 12. In still other cases, it may be desirable to supply more solvent than air to the hose 12. For any given application, the optimum solvent-to-air ratio may be determined through experimentation. Generally, the object is to optimize the scrubbing and cleaning action in the hose 12 by optimizing turbulence in the solvent, which in turn minimizes cleaning time. This generally also minimizes solvent consumption. If the air pressure is set equal to the solvent pressure, the air and solvent will always mix to produce a turbulent flow. No matter what the solvent system does, the apparatus 10 and electric control circuit 70 will maintain the set solvent-to-air ratio and therefore a proper turbulent action in the solvent, since the air pressure will follow fluctuations in the solvent pressure.

For example, in an automobile painting system, the manifold 40 may be a color change manifold connected through separate valves 46 to a number of different color pressurized paint sources (not shown). An outside or host controller (not shown) will open a paint valve 46 for coating an automobile body with a particular color paint, close the valve when painting with such color paint is completed, open the mixing valve 42 and 44 for passing a turbulent solvent-to-air mixture through the paint hose 12 to clean the paint from the hose 12 and its attached spray gun 48. The electric control circuit 70 also may close the solvent input to valve 42 and 44 while opening an inlet air valve 45 to pass a short duration burst of high pressure air through the manifold 40 and the hose 12 to dry the hose 12 prior to selecting the next paint. Then the electric controller closes the valves 42 or 44 and 45 and selects the next color paint for painting the next automobile body with a different color paint.

It will be appreciated that various modifications and changes may be made in the above described preferred embodiment of the fluid hose cleaning apparatus 10 without departing from the spirit and the scope of the following claims. Further, it will be appreciated that the apparatus 10 may be readily adapted to clean various fluid-carrying lines, manifolds and other apparatus.

We claim:

1. Apparatus for cleaning a fluid hose comprising, in combination, means for supplying a flow of pressurized solvent to said hose, electrical means for sensing the pressure of the solvent delivered to said hose, a source of compressed air, and means responsive to said sensed solvent pressure for supplying a flow of compressed air from said compressed air source to said hose at a predetermined pressure relative to said sensed solvent pressure, whereby said supplied solvent and said compressed air are mixed to produce a turbulent flow.

2. Apparatus according to claim 1, wherein said means for supplying a flow of compressed air includes a regulating valve means for controlling the pressure of the compressed air supplied to said hose, and said means responsive to said sensed solvent pressure for controlling said regulating valve means.

3. Apparatus according to claim 2, wherein said solvent pressure sensing means comprises a pressure to current transducer.

4. Apparatus according to claim 3, wherein said regulating valve means is responsive to an electric signal for controlling the pressure of the supplied compressed air and wherein said means responsive to said sensed solvent pressure for controlling said regulating valve means includes a computer.

5. Apparatus according to claim 2, wherein said solvent pressure sensing means comprises a pressure to voltage transducer.

6. Apparatus according to claim 5, wherein said regulating valve means is responsive to an electric signal for controlling the pressure of the supplied compressed air and wherein said means responsive to said sensed solvent pressure for controlling said regulating valve means includes a computer.

7. Apparatus according to claim 2, wherein said regulating valve means is responsive to said compressed air source for controlling the pressure of said compressed air supplied to said hose, and wherein said means responsive to said sensed solvent pressure supplies compressed air from said compressed air source to said regulating valve means.

8. A method for cleaning a hose with a solvent comprising the steps of: supplying a solvent under pressure to the hose; electrically sensing the pressure of the supplied solvent; mixing compressed air with the supplied solvent to create turbulence in the supplied solvent; and electrically controlling the pressure of the supplied compressed air in response to the sensed solvent pressure and said supplied air pressure.

9. The method for cleaning a hose of claim 8, wherein said supplied air pressure is controlled to maintain optimum turbulence in the supplied solvent.

10. The method for cleaning a hose of claim 8, wherein said supplied air pressure is controlled to maintain a predetermined ratio between the supplied solvent and air.

* * * * *